US006792918B1

(12) United States Patent
Halsall

(10) Patent No.: US 6,792,918 B1
(45) Date of Patent: Sep. 21, 2004

(54) VACUUM RELIEF MODULAR RESERVOIR ASSEMBLY

(75) Inventor: Robert Halsall, Washington, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/674,126

(22) Filed: Sep. 29, 2003

(51) Int. Cl.[7] ..... F02M 37/00; F02M 55/00

(52) U.S. Cl. ..... 123/446; 123/457; 123/506; 123/509; 123/510; 123/198 D

(58) Field of Search ..... 123/446, 456, 123/457, 467, 506, 509, 510, 516, 198 D

(56) References Cited

U.S. PATENT DOCUMENTS 5,477,829 A * 12/1995 Hassinger et al. ..... 123/467
5,731,515 A * 3/1998 Tominaga et al. ..... 73/119 A
6,253,739 B1 * 7/2001 Golomb et al. ..... 123/509
2003/0159681 A1 * 8/2003 Schueler et al. ..... 123/514

* cited by examiner

*Primary Examiner*—Weilun Lo
(74) *Attorney, Agent, or Firm*—Laura C. Hargitt

(57) ABSTRACT

The present invention provides a fuel system that utilizes a first valve assembly and a second valve assembly within a fuel tank. Preferably, the first valve assembly is in parallel with the second valve assembly and provides a greater bias against fuel flow from the fuel tank assembly to the fuel rail. The second valve assembly allows fuel flow from the fuel tank assembly to the fuel rail and is biased with a lower bias than that for the first valve assembly. Additionally, the second valve assembly allows a lower fuel flow rate from the fuel tank assembly to the fuel rail than does the first valve assembly.

15 Claims, 3 Drawing Sheets

VACUUM RELIEF MODULAR RESERVOIR ASSEMBLY

FIELD OF THE INVENTION

The present invention relates generally to a fuel-valve, and more particularly, the present invention relates to a fuel valve that maintains fuel pressure in a fuel rail.

BACKGROUND OF THE INVENTION

Modular reservoir assemblies (MRAs), also known as fuel pump modules or simply as senders are devices positioned in a vehicle fuel tank assembly used to supply fuel to the engine and provide other functions such as measuring fuel level and tank pressure. MRAs contain a check valve designed primarily to maintain fuel system pressure and to keep fuel from draining from the fuel rail and fuel injectors back to the tank after the engine and fuel pump is shut down. Maintaining pressure in the fuel rail and injectors is especially important when the engine is hot to keep the fuel from boiling. If the fuel boils, vapor bubbles form in the fuel rail and injectors, thereby making the engine difficult to start.

During the normal cooling cycle of the fuel system, a small vacuum is often created in the fuel rail and injectors due to differential thermal contraction of the fuel. Since the check valve will open under vacuum and allow fuel to flow into the fuel rail, the amount of vacuum produced is limited by the opening pressure of the check valve. Modern check valves (such as Forward Flow Check Valves-FFCVs) have higher opening pressures than most older fuel pump (or MRA) check valves because they incorporate a return spring to help keep the valve closed. Older design check valves use a lighter spring or no spring at all, instead relying only on gravity to close the check valve. The much higher opening pressure of the new FFCVs leads to much higher vacuums in fuel delivery components, such as MRA, the filter, fuel lines, fuel rail, fuel pressure regulator and fuel injectors. This excess vacuum may damage components not designed for vacuum, and has been observed to cause small air leaks which allow air to leak into the MRA, lines, the fuel rail, injectors, regulator or other components designed only to resist pressure, but not necessarily to resist vacuum. In addition, even if no air leaks occur, under certain conditions or with certain gasoline, vacuum within the fuel system has the potential of causing air/vapor bubbles from an air leak or air dissolved in the fuel to form from a gas leak and air dissolved in the fuel.

The problem with air intrusion from fuel delivery components or air/vapor bubble formation from the fuel is that it degrades fuel system performance by slowing down the pressurization of the fuel rail. The present invention was developed in light of these and other drawbacks.

SUMMARY OF THE INVENTION

To address these and other drawbacks, the present invention provides a fuel system that utilizes a first valve assembly and a second valve assembly. Preferably, the first valve assembly is in parallel with the second valve assembly and provides a greater bias against fuel flow from the fuel tank assembly to the fuel rail or to the environment should the external line leak. The second valve assembly allows fuel flow from the fuel tank assembly to the fuel rail and is set at a lower bias than that for the first valve assembly. Additionally, the second valve assembly allows a lower fuel flow rate from the fuel tank assembly to the fuel lines and rail than does the first valve assembly.

Other aspects of the invention will be apparent to those skilled in the art after reviewing the drawings and the detailed description below.

BRIEF DESCRIPTION OF THE DRAWINGS

The present invention will now be described, by way of example, with reference to the accompanying drawings, in which.

DETAILED DESCRIPTION OF THE PRESENT INVENTION

Figure 1:
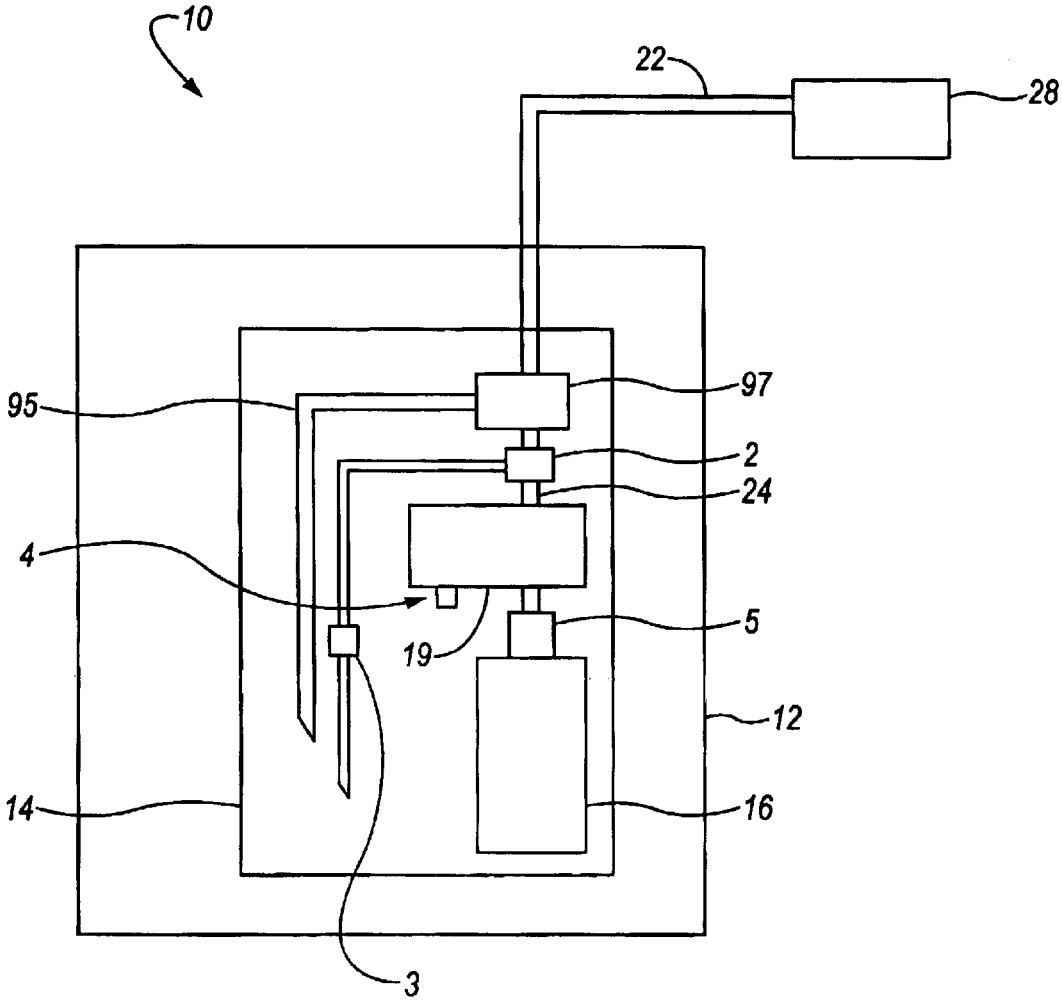
FIG. 1 is a schematic view of a vacuum relief valve system according to an embodiment of the invention.

Referring now to FIG. 1, the fuel system 10 is shown comprising a fuel tank assembly 12; MRA 14; fuel pump 16; assemblies 2, 3, 4, and 5; filter 19; and fuel rail 28. Fuel pressure regulator 97 and regulator exhaust line 95 are also provided. Assemblies 2, 3, 4, and 5 can include any one of a forward flow check valve (FFCV 18) (see FIGS. 2–7), flow limited vacuum relief valve (FLVRV 20) or a combination thereof as will be discussed in greater detail. Although assemblies 2, 3, 4 and 5 are shown together in FIG. 1, it is understood that any embodiment may contain a subset of those shown. It is also understood that the FFCV 18 and the fuel pump 16 can be combined as one unit.

The fuel tank assembly 12 can be any fuel container for holding fuel such as gasoline, diesel, propane or other known fuel source. MRA 14 includes the fuel pump 16 for providing fuel under pressure to fuel rail 28 to fuel an internal combustion engine. FFCV 18 can be a return biased forward flow valve or other known means of allowing one way flow of fuel from fuel tank assembly 12 to fuel rail 28. The return bias provides a force which the fuel needs to overcome before the valve opens and allows fuel flow from the fuel tank assembly 12 to the fuel rail 28. The return bias can be provided by any known means, such as a spring controlled valve or other means. Preferably, FFCV 18 allows a large volume of fuel to freely flow toward fuel rail 28 and restricts flow from fuel rail 28 back to fuel tank assembly 12.

FLVRV 20 is preferably positioned in parallel with FFCV 18 with its inlet below the level of fuel in the MRA to provide a parallel fuel flow to fuel rail 28. Thus, any FLVRV 20 and FFCV 18 described in the present application can be used together to provide fuel flow according to the present invention. FLVRV 20 also is preferably a forward flow control valve as will be described in greater detail. Preferably, however, FLVRV 20 has a lower return bias than does FFCV 18, such that only a minimal pressure differential between the fuel tank assembly 12 and fuel rail 28 allows fuel to flow from fuel tank assembly 12 to fuel rail 28. To prevent fuel from siphoning out of the fuel tank assembly if a fuel line leak occurs (such as during an accident), FLVRV 20 preferably allows only a very small flow rate of fuel to flow from fuel tank assembly 12 to fuel rail 28. In a most preferred embodiment, FLVRV 20 allows a forward flow of fuel when greater than or equal to a 2 kpa of pressure differential is observed between fuel tank assembly 12 and adjacent portion of fuel line 22. Moreover, in a preferred embodiment, a maximum flow rate through FLVRV 20 is less than 5 cc per minute at 10 kpa differential pressure. It should be noted that FFCV can be any type of flow valve, and is not restricted to that disclosed herein.

Figure 2:
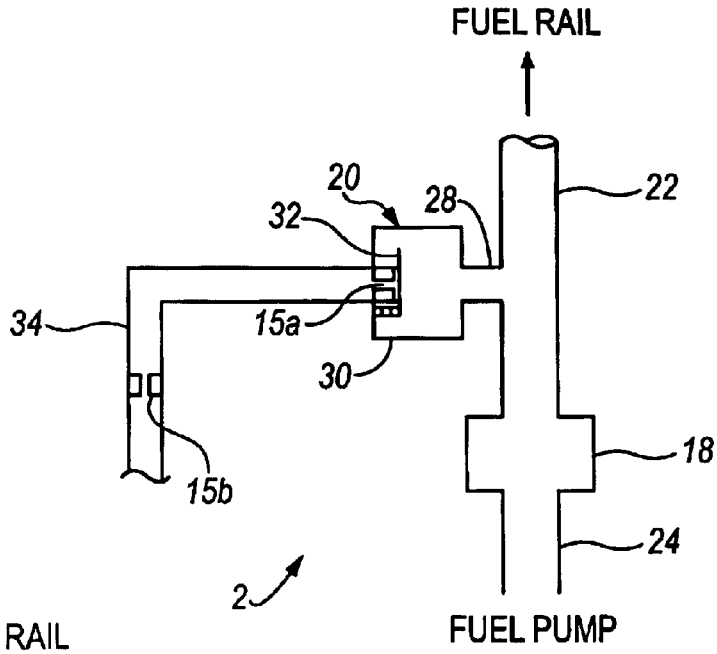
FIG. 2 is a schematic view of a vacuum relief valve system according to an embodiment of the invention.

Referring now to FIG. 2, a first embodiment of FLVRV 20 is shown and described. The embodiment corresponds to assembly 2 in FIG. 1. In FIG. 2, fuel line 28 connects FLVRV 20 to fuel line 22. FLVRV 20 includes a chamber 30 and flapper valve 32 preferably with integral 0.010 orifice valve seat. Also, orifice 15*a* or 15*b* can be included to provide the desired diameter. The flapper valve 32 is flexibly supported by the chamber 30 such that a forward pressure differential toward fuel rail 28 causes flapper valve 32 to move to an open position and allow fuel flow from fuel tank assembly 12, through fuel line 34, passing flapper valve 32, through chamber 30 and ultimately entering fuel rail 28. Accordingly, fuel line 28 or 34 contains an orifice with an approximate diameter of 0.010 in. instead of an orifice combined with a flapper valve with integral orifice-valve seat. Accordingly, the flexibility of flapper valve 32 provides the return bias to prohibit return flow. As such, the material of flapper valve 32 is preferably chosen to provide a minimal return bias that is less than FFCV 18.

Figure 3:
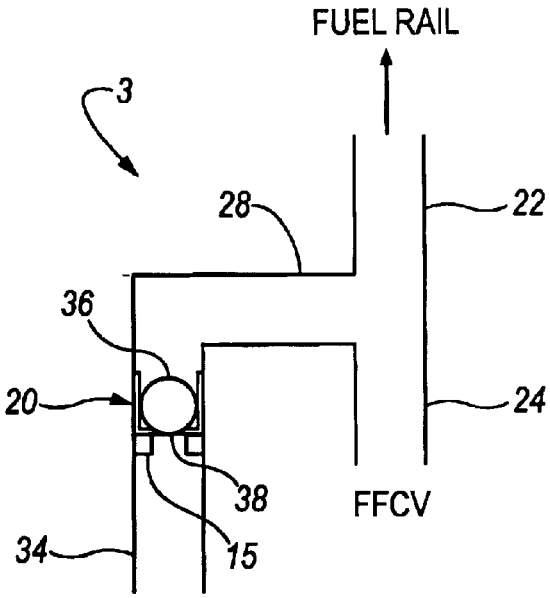
FIG. 3 is a schematic view of a vacuum relief valve system according to an embodiment of the invention.

Referring now to FIG. 3, a second embodiment of FLVRV 20 is shown and described. The embodiment corresponds to assembly 3 in FIG. 1. In FIG. 3, FLVRV 20 includes a check ball valve that utilizes ball 36 and seat 38 preferably with integral orifice of approximately 0.010 in. diameter in fuel line 34 coming from fuel tank assembly 12. Also, orifice 15 can be included to provide the desired diameter. Preferably, seat 38 is a soft seat such as rubber or other suitable material. In operation, a pressure differential from fuel tank assembly 12 to fuel rail 28 of greater than 5 kpa causes ball 36 to become unseated from seat 38 to thereby allow fuel flow from fuel tank assembly 12 to fuel rail 28.

Figure 4:
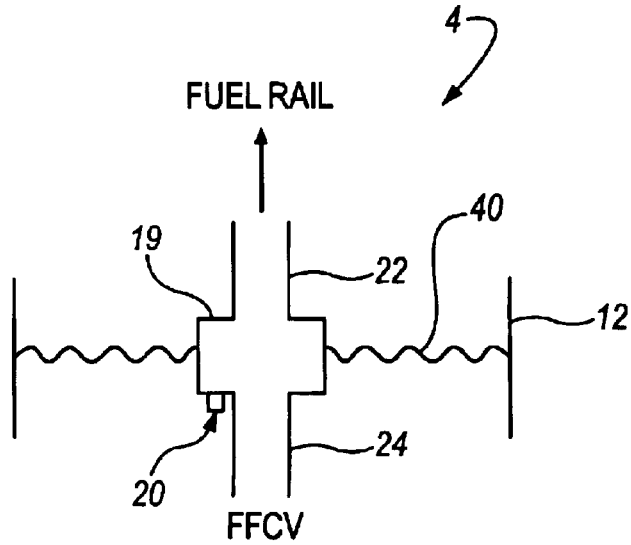
FIG. 4 is a schematic view of a vacuum relief valve system according to an embodiment of the invention.

Referring now to FIG. 4, a third embodiment of the present invention is shown and described. The embodiment corresponds to assembly 4 in FIG. 1. In FIG. 4, an FFCV 18 is disposed in filter 19 at least partially in fuel 40 within fuel tank assembly 12. FLVRV 20 is disposed at a submerged portion under fuel 40 and on the housing of the filter 19. FLVRV 20 can be a flapper valve, ball valve or any other known check valve to allow a 2 kpa differential pressure between fuel 40 and adjacent part of line 22 to open and thereby allow bypass. Additionally, FLVRV 20 preferably has a lower flow rate than does FFCV 18.

Figure 7:
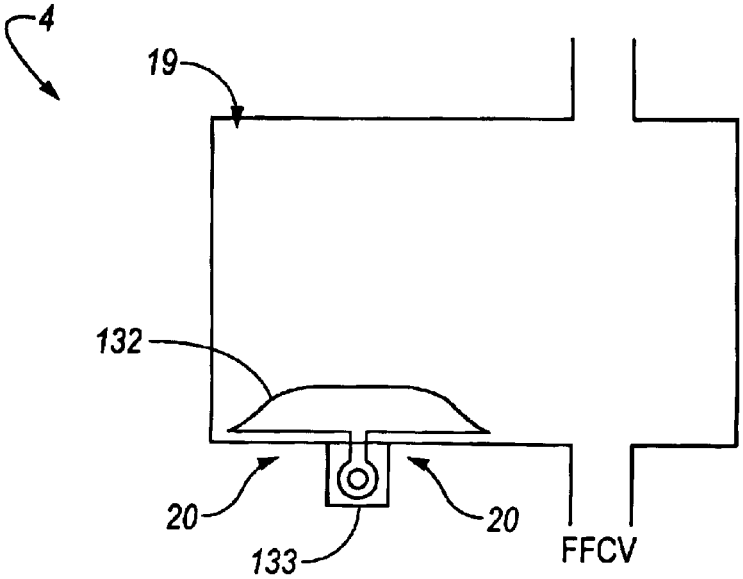
FIG. 7 is a schematic view of a vacuum relief valve system according to an embodiment of the invention.

Referring to FIG. 7, an embodiment of FLVRV 20 in FIG. 4 is described in greater detail. In FIG. 7, a mushroom valve is positioned over port 133. Fuel pressure from within the filter 19 causes the mushroom valve to stay closed and prohibit flow from traveling out the port 133.

Figure 5:
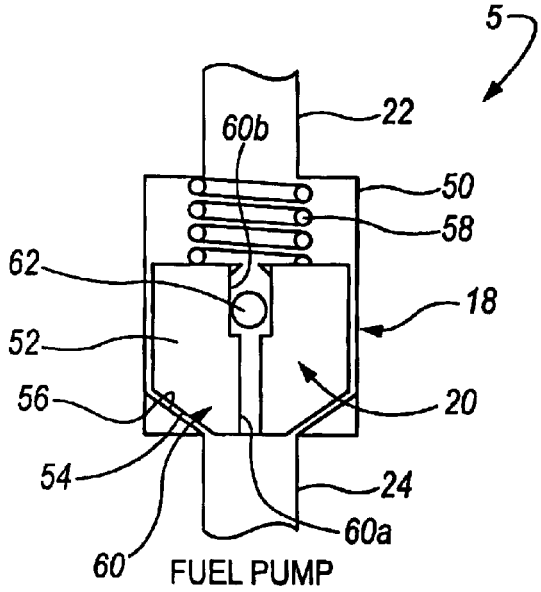
FIG. 5 is a schematic view of a vacuum relief valve system according to an embodiment of the invention.

Referring now to FIG. 5, a fourth embodiment of the present invention is shown and described. The embodiment corresponds to assembly 5 in FIG. 1. In FIG. 5, the FLVRV 20 and FFCV 18 are contained within one unit. Here, FFCV 18 includes an outer shell 50 that connects fuel pump 24 to fuel line 22. Disposed within outer shell 50 is a valve element 52. Valve element 52 acts as the FFCV 18. Valve element 52 preferably has an angled face 54 which mates with seat 56 when valve element 52 is in a closed position. Spring 58 is preferably a coil spring which biases valve element 52 in its closed position. However, spring 58 can be any other known biasing means.

Orifice 60 has a narrow portion 60*a* and a wide portion 60*b*. Orifice 60 provides fluid connection between fuel pump 24 and fuel line 22 to provide the bleeding function of FLVRV 20 to compensate for pressure differentials within the fuel rail 28. Check ball 62 is disposed within wide portion 60*b* to selectively allow flow from fuel pump 24 to fuel line 22. Check ball 62 is preferably wider than narrow portion 60*a* such that it cannot fall therethrough. Check ball, narrow portion 60*a*, and wide portion 60*b* act as FLVRV 20.

In operation, large fuel flow for pressurization pushes valve element 52 off seat 56, against the bias of spring 58, to allow a large fuel flow. To compensate for pressure differentials, gravity or light spring bias of check ball 62 allows a trickle flow of fuel to flow from fuel line 24, through orifice 60*a* and to fuel line 22, against minimal return bias from check ball 62. Orifice 60*a* is preferably about 0.010 in. diameter to provide flow control function. Check ball, narrow portion 60*a*, and wide portion 60*b*, act as FLVRV 20.

Figure 6:
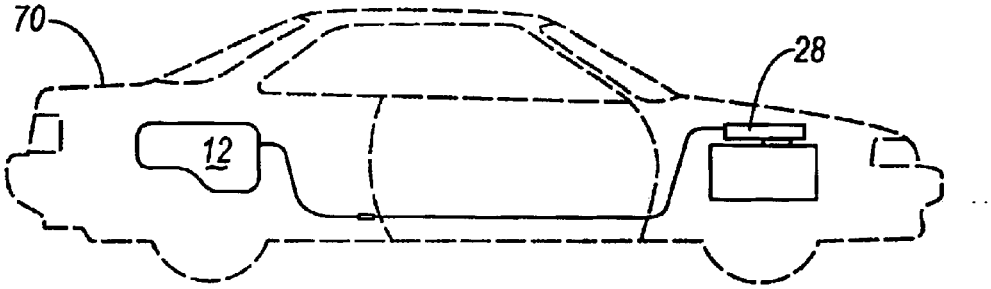
FIG. 6 is a schematic view of a vehicle using a fuel system according to the present invention.

Referring to FIG. 6, a vehicle 70 is shown having a fuel tank assembly 12. It is understood that the fuel tank assembly 12 includes FLVRV 20, FFCV 18 within the fuel tank assembly 12 and a fuel rail 28 as described above. As will be understood by one skilled in the art, vehicle 70 utilizes all the above described embodiments of the present invention to provide fuel flow from the fuel tank assembly 12 and to the fuel rail 28 for powering of the vehicle 70. FFCV ensures that large amounts of fuel does not flow back to the fuel tank assembly 12 while FLVRV ensures that pressure differentials are properly compensated by allowing trickle flow of fuel to fuel rail 28 under minimal return bias.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A system for allowing fuel flow from a fuel tank assembly to a fuel rail of an internal combustion engine, the system comprising:

a first valve assembly allowing fuel flow from the fuel tank assembly to the fuel rail against a first predetermined bias; and a second valve assembly allowing fuel flow from the fuel tank assembly to the fuel rail against a second predetermined bias, the second valve assembly allowing fuel flow in parallel with the first valve assembly;

wherein the second predetermined bias is lower than the first predetermined bias; and wherein the second valve assembly allows a maximum flow rate of fuel to flow from the fuel tank assembly to the fuel rail that is lower than a maximum flow rate of the first valve assembly.

2. The system according to claim 1, wherein the second valve assembly includes:

an outer shell;

a fuel line connecting the fuel tank assembly to the outer shell; and a flapper valve disposed within the outer shell and over the fuel line to provide the second predetermined bias.

3. The system according to claim 2, wherein the flapper is constructed of a material that provides an elastic bias to generate the second predetermined bias.

4. The system according to claim 1, wherein the second valve assembly comprises:

a ball; and a seat;

wherein the ball is normally positioned on the seat against gravitational force to provide the second predetermined bias.

5. The system according to claim 1, wherein the first valve assembly and the second valve assembly arm disposed within an outer shell, wherein the outer shell is disposed within fuel in the fuel tank assembly.

6. The system according to claim 1, wherein:

the first valve assembly comprises:

an outer shell;

a valve element disposed within the outer shell;

a biasing member pressing the valve element into a closed position and providing the first predetermined bias;

the second valve assembly comprises:

a channel passing through the valve element; and a valve disposed in the channel and providing the second predetermined bias.

7. The system according to claim 6, wherein the valve is a ball disposed within the channel to provide the second predetermined bias.

8. A vehicle comprising:

a system for providing fuel from a fuel tank assembly to a fuel rail for an internal combustion engine of the vehicle, the system comprising:

a first valve assembly allowing fuel flow from the fuel tank assembly to the fuel rail against a first predetermined bias; and a second valve assembly allowing fuel flow from the fuel tank assembly to the fuel rail against a second predetermined bias, the second valve assembly allowing fuel flow in parallel with the first valve assembly;

wherein the second predetermined bias is lower than the first predetermined bias; and wherein the second valve assembly allows a maximum flow rate of fuel to flow from the fuel tank assembly to the fuel rail that is lower than a maximum flow rate of the first valve assembly.

9. The vehicle according to claim 8, further comprising:

an outer shell;

a fuel line connecting the fuel tank assembly to the outer shell; and a flapper valve disposed within the outer shell and over the fuel line to provide the second predetermined bias.

10. The vehicle according to claim 9, wherein the flapper is constructed of a material that provides an elastic bias to generate the second predetermined bias.

11. The vehicle according to claim 8, further comprising:

a ball; and a seat;

wherein the ball is normally positioned on the seat against gravitational force to provide the second predetermined bias.

12. The vehicle according to claim 8, wherein the first valve assembly and the second valve assembly are disposed within an outer shell, wherein the outer shell is disposed within fuel in the fuel tank assembly.

13. The vehicle according to claim 8, wherein:

the first valve assembly comprises:

an outer shell;

a valve element disposed within the outer shell;

a biasing member pressing the valve element into a closed position and providing the first predetermined bias;

the second valve assembly comprises:

a channel passing through the valve element; and a valve disposed in the channel and providing the second predetermined bias.

14. The vehicle according to claim 13, wherein the valve is a ball disposed within the channel to provide the second bias.

15. A system for providing fuel from a fuel tank assembly to a fuel rail comprising:

an outer shell within the fuel tank having a substantially cylindrical shape, wherein the outer shell has a valve seat disposed at a upstream location with respect to fuel flow from the fuel pump to the fuel rail;

a valve disposed within the outer shell and having a tapered face to seat against the valve seat;

a spring disposed within the outer shell and biasing the valve against the valve seat;

a channel disposed within the valve, wherein the channel has a narrow portion proximate the upstream location of the valve and a wide portion proximate a downstream portion of the valve; and a check ball disposed within the wide portion of the channel;

wherein the spring provides a first predetermined bias to inhibit opening of the valve against fuel flow from the fuel tank assembly to the fuel rail;

wherein the check ball provides a second predetermined bias to inhibit fuel flow from the fuel tank assembly, through the channel, and to the fuel rail;

wherein the first predetermined bias is greater than the second predetermined bias; and wherein the valve allows a larger fuel flow from the fuel tank assembly to the fuel rail when the valve is in an open position than does the channel when the check ball is in an open position.

* * * * *